United States Patent [19]

Vincent

[11] Patent Number: 4,624,491

[45] Date of Patent: Nov. 25, 1986

[54] ELECTRICALLY-OPENED LATCH, IN PARTICULAR FOR MOTOR VEHICLE DOORS

[75] Inventor: Bernard Vincent, Remiremont, France

[73] Assignee: Compagnie Industrielle de Mecanismes en abrege C.I.M., France

[21] Appl. No.: 588,602

[22] Filed: Mar. 12, 1984

[30] Foreign Application Priority Data

Mar. 14, 1983 [FR] France ..... 83 04139

[51] Int. Cl.[4] ..... E05C 3/00

[52] U.S. Cl. ..... 292/201; 70/279; 74/89.15; 185/40 R; 292/216

[58] Field of Search ..... 292/201, 144, 216; 70/279, 282; 74/89.15; 185/40 R

[56] References Cited

U.S. PATENT DOCUMENTS

| | | | |
|---|---|---|---|
| 2,943,880 | 7/1960 | Joachim et al. | 292/201 |
| 3,359,767 | 12/1967 | Arlauskas et al. | 292/201 X |
| 3,504,511 | 4/1970 | Allen | 292/201 X |
| 3,655,240 | 4/1972 | DuRocher et al. | 292/201 X |
| 4,135,377 | 1/1979 | Kleefeldt | 70/279 X |
| 4,290,634 | 9/1981 | Gelhard | 292/201 |

*Primary Examiner*—Robert L. Wolfe
*Assistant Examiner*—Lloyd A. Gall

[57] ABSTRACT

The latch comprises a bolt 20 pivotally mounted on a support plate 10, a latch 3 cooperative with the bolt, a rotatable lever driven in rotation by an electric system 9, 7, 5, 6 for opening the latch for pivoting the catch 3 and releasing the bolt 20. The electric system comprises a motor 9 having a low reversibility torque and sufficient power, and a spiral return spring 8 which is stressed during the opening by the rotation of the motor 9, this spring 8 being capable of being resiliently released when the motor 9 is no longer carrying current, after the opening of the latch, so as to permit the return of the lever 4 and of the latch 3 to their initial position under the effect of their own springs 21, 29.

7 Claims, 3 Drawing Figures

ELECTRICALLY-OPENED LATCH, IN PARTICULAR FOR MOTOR VEHICLE DOORS

BACKGROUND OF THE INVENTION

1. Field of the Invention

The present invention relates to a latch for a motor vehicle door, of the type which is opened electrically.

2. The Prior Art

As is known, present motor vehicle door latches must perform a number of functions which may differ in accordance with the vehicles. These functions are generally performed by a mechanical logic disposed between a retaining system and control means.

The functions to be performed are usually: the opening, the closing, the locking of the latch from the inside and from the outside of the vehicle, and the "child" locking of the rear doors. The points of the mounting of the control means are imposed by, and related to, each type of vehicle.

These mechanical latches have the drawback of being specific to an arrangement of the control means, and therefore to a given vehicle. Consequently, it is advantageous to replace the mechanical logic by an electrical logic which is not related to a given type of vehicle. However, for reasons of safety, an electric latch must remain capable of being operated when the source of current is lacking, i.e. it must be possible to open the door from the interior, and close the door, in such an event.

Known latches having an electric opening system are of a relatively complicated structure and consequently expensive, since they require either means for reversing the supply voltage for the motor or a clutch which is capable of isolating the motor from the rest of the kinematic system of the latch when the latter is open so as to permit the locking thereof upon the next closure.

SUMMARY OF THE INVENTION

An object of the invention is consequently to provide a latch of the electrically opened type, which remains capable of operating in the event of lack of current, irrespective of the moment when this current is interrupted in the opening-closing cycle, and whose structure is simplified relative to that of known electric latches and is consequently much less expensive. Further, this latch must be integrated with a system comprising an electric control performing the locking-unlocking functions.

The latch according to the invention comprises a bolt pivotally mounted on a support plate of a case, a catch also pivotally mounted on the plate and adapted to cooperate with the bolt in such manner as to maintain it in a closing position under the action of a first resiliently yieldable element, a lever rotatively mounted on the plate and capable of being driven in rotation by an electric system controlling the opening of the latch so as to swing the catch in opposition to the opposing force exerted by its resiliently yieldable return element, thereby releasing the bolt and a keeper inserted in the bolt.

According to the invention, the electric system controlling the opening includes a motor of sufficient power to overcome the resistance of the resiliently yieldable return element of the catch and of a low resistibility torque, and a second resiliently yieldable element interposed between the motor and the lever for driving the catch, said second element being stressed by the motor and being capable of being resiliently released when the motor is no longer supplied with current so as to return the motor to its initial position, the lever and the catch being resiliently returned to their initial position after the releasing of the bolt and the pivoting of the bolt to its open position.

According to one embodiment of the invention, the resiliently yieldable return element for returning the kinematic system controlling the opening is a spiral spring which is mounted coaxially on a shaft driven by the output shaft of the motor, with one end fixed to said driven shaft and its other end connected to the support plate, and the shaft of the motor is connected to the lever by means ensuring the pivoting of the lever and of the catch in the direction for releasing the bolt when the motor is operating and stressing the spiral spring.

These means (motor, gearing) are automatically actuated in the opposite direction by the release of the spiral spring after the supply of current to the motor has stopped, thereby allowing the return of the lever and the catch to their initial positions under the effect of their particular springs.

The low reversibility torque of the motor permits the use of a return spring, preferably of the spiral type, which has in particular the advantage of presenting a torque which varies little for large travels.

Further features and advantages of the invention will be apparent from the following description with reference to the accompanying drawings which illustrate a non-limiting embodiment of the latch according to the invention.

BRIEF DESCRIPTION OF THE DRAWINGS

FIG. 1 shows a latch 1 mounted on a door 2 of a motor vehicle and cooperable with a keeper 12 fixed to a body post 19, this keeper consisting of a bent sheet of metal 13 and a pin 16, this sheet 13 being fixed to the upright 19 by two screws 15.

DETAILED DESCRIPTION OF THE PREFERRED EMBODIMENTS

Figure 1:
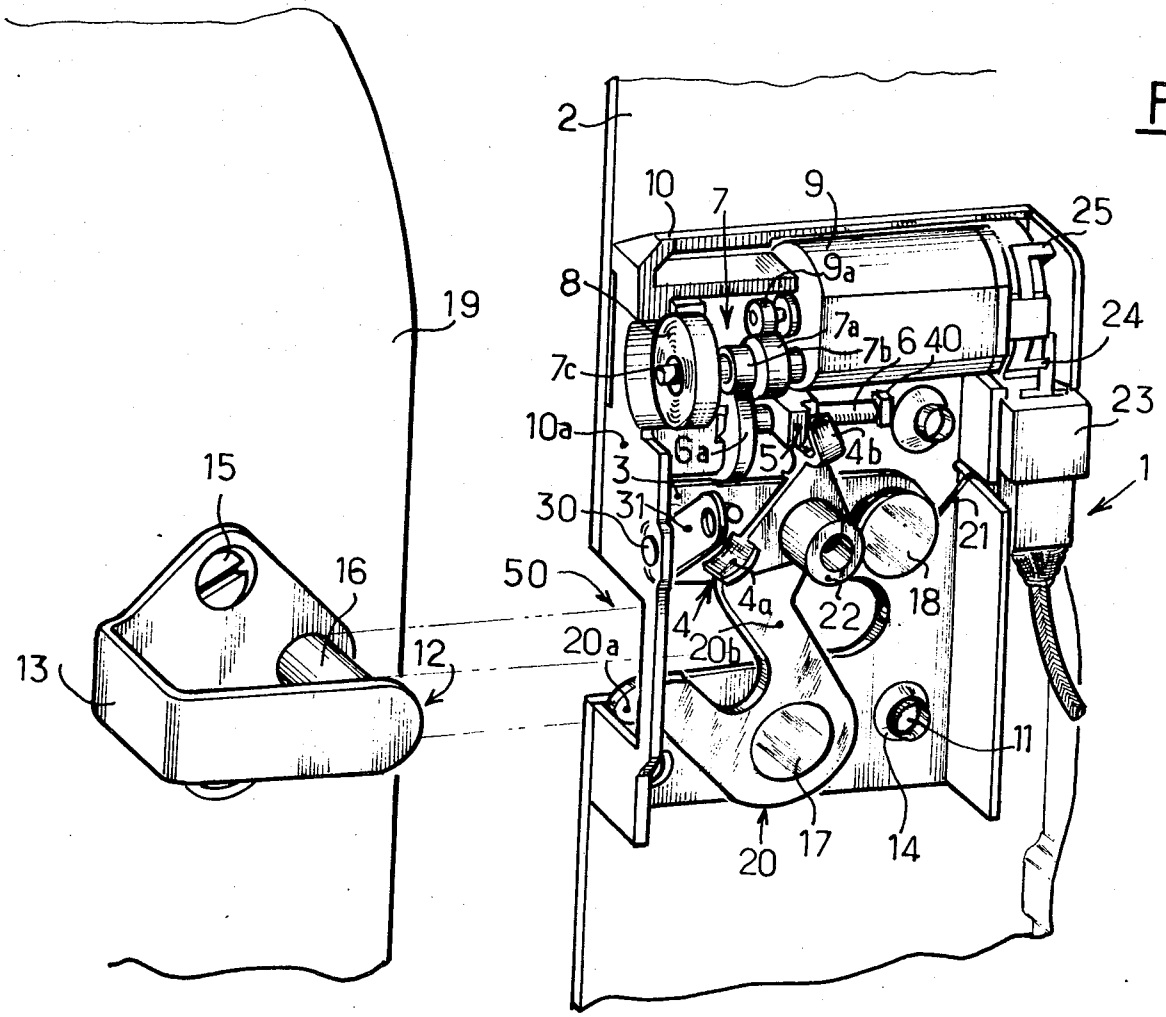
FIG. 1 is a perspective view of one embodiment of the latch for a motor vehicle door according to the invention, in the open position on the edge of the door, and the corresponding keeper mounted on the vehicle body and associated with the latch.

The latch 1 comprises a bolt 20 pivotally mounted on a support plate 10 which is fixed to the inner edge of the door 2 by screws 11 screwed in tapped collars 14 of said front support plate 10 which constitutes a part of a case in which are housed all the component parts of the latch and whose upper part has not been shown.

This case contains retaining elements, namely the bolt 20 and a catch 3 which are pivotally mounted on the plate 10 by pins 17 and 18 respectively. Conventionally, the bolt 20 has two arms 20*a*, 20*b* which define therebetween a notch, and the edge of the door 2 has a transverse opening 50 which is adapted, in the same way as the notch of the bolt 20, to receive the pin 16 of the keeper 12 when the door 2 of the vehicle is closed.

The catch 3 is provided with a lug or pin 3*b* and a lower nose portion 3*a* and it is constantly resiliently biased by a spring 21 which tends to turn it about its pin 18 in the counter-clockwise direction so that the catch 3 bears on either one of the arms 20*a*, 20*b* of the bolt 20, depending on whether the latch is in the "fully closed" position (arm 20*a*) or in the "first safety" position (arm 20*b*). Thus it can be seen in FIG. 2 that, when the latch is closed and the pin 16 is located in the notch of the bolt 20, the nose portion 3*a* of the catch 3 cooperates with an end ramp 20*a* or 20*b* so as to maintain the bolt 20 locked under the force exerted by the resiliently yieldable element 21.

The latch further comprises an opening control which includes a lever 4 mounted to pivot about a stud 22 fixed to the case (not shown). The lever 4 is provided with an end flat surface 4*a* which is cooperable with the pin 3*b* so as to pivot the catch 3 in the clockwise direction, in opposition to the force exerted by the spring 21, when the lever is itself driven in rotation in this direction. The lever 4 is in addition provided, on the opposite side to the flat surface 4*a*, with a bent tab 4*b* which is cooperable with a nut 5 which is mounted to be prevented from rotating but to be movable in translation on a screw 6 fixed by any suitable means to the support plate 10. These members are so dimensioned that if the nut 5 is shifted from one end to the other of the screw 6, for example from the left to the right as viewed in FIGS. 1 and 2, this nut correspondingly drives in rotation the lever 4 through the tab 4*b*.

The opening control mechanism further comprises an electromechanical system which is more particularly part of the invention and which has for function to control the movements of the nut 5 on the screw 6. This electromechanical system comprises an electric motor 9 secured to the upper part of the support plate 10, a speed reducing gear train 7 providing the connection between the motor 9 and the nut 5, and a resiliently yieldable element for returning the nut 5 to its initial position and formed, in the presently-described embodiment, by a spiral spring 8 which is capable of actuating the gear train 7 and the motor 9 in opposite directions after the latter has stopped.

The motor 9 is a dc motor and it is supplied with current by a connector 23 with interposition of two tabs 24, 25. This motor may be started up by an electric switch 26 located on the outer side of the door 2 or by an electric switch placed inside the door, these switches being connected to the motor 9 by connections (not shown). A driving gear pinion 9*a* is fixed to the end of the output shaft of the motor 9 and is meshed with a gear wheel 7*a* rigid with a shaft 7*c* on the end of which is coaxially mounted the spiral spring 8. One end of the latter is connected to the shaft 7 while the other end is fixed by any suitable means to the upper part of the support plate 10. The shaft 7 also carries a gear pinion 7*b* which is meshed with a gear wheel 6*a* coaxial with the screw 6 which it can drive in rotation in one direction or the other, depending on the direction of rotation of the output shaft of the motor 9 in accordance with the driving force being supplied by the motor 9 or the spring 8.

Figure 2:
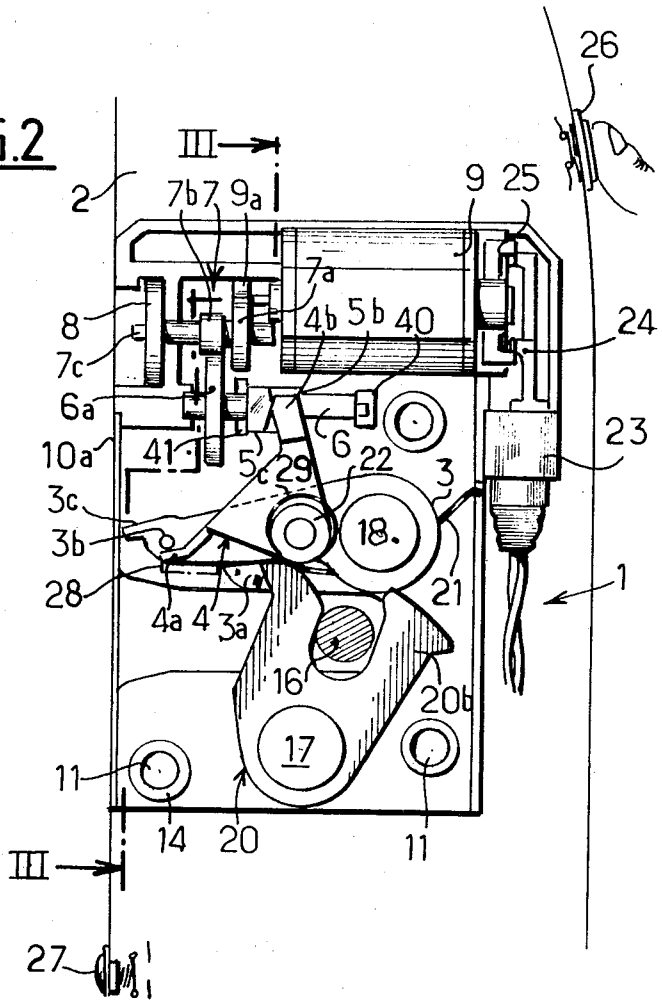
FIG. 2 is an elevational view of the latch shown in FIG. 1, without its upper case and without its safety control in the event of a current supply breakdown, in the closed position with the keeper engaged in the bolt.

Further, a torsion spring 29 mounted in the known manner constantly biases the lever 4 to rotate in the counter-clockwise direction and therefore in such manner that the tab 4*b* is constantly urged against the nut 5 and toward a stop 28 rigid with the case. Moreover, the return spring 21 tends to return the catch 3 downwardly in the counter-clockwise direction into abutment with the lever 4 through the pin 3*b* which is part of this catch (FIG. 2).

Figure 3:
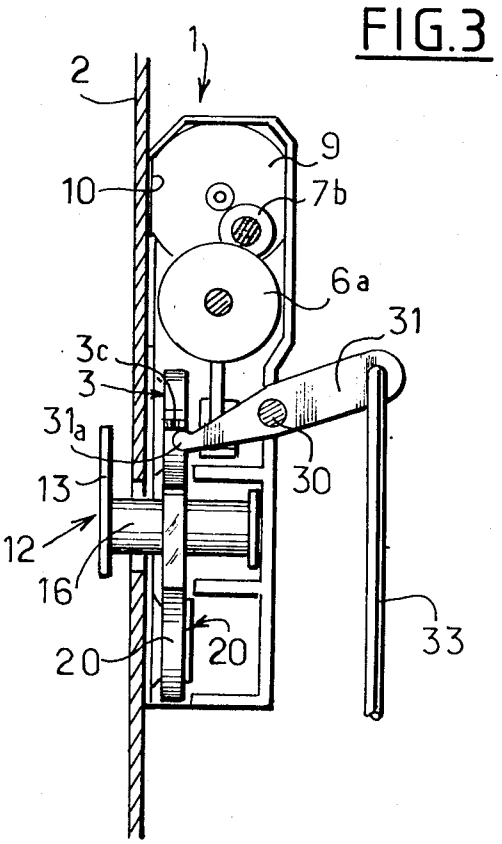
FIG. 3 is an end elevational view of the latch taken along line III—III of FIG. 2, showing the mechanical safety control.

The latch is completed by a safety control device comprising a lever 31 (FIG. 3) pivotally mounted on a wing 10*a* of the plate 10 by a pin 30. One end 31*a* of the lever 31 is in contact with the lower surface of an end nose portion 3*c* of the catch 3 so as to raise the latter in the clockwise direction when a pull is exerted on a rod 33 pivotally mounted on the opposite end of the lever 31. When the latch is closed (FIG. 2) and, in the event of a breakdown in the electric supply system, it is thus possible to raise the catch 3 by pulling on the rod 33 so as to disengage the bolt 20 from the retaining nose portion 3*a* and permit the opening of the latch by swinging the bolt 20 and extracting the keeper 12.

The latch just described operates in the following manner:

When the door 2 is closed, the pin 16 enters the opening 50 and the fork of the bolt 20 between the arms 20*a*, 20*b*. The bolt 20 is driven in rotation in the clockwise direction from its position shown in FIG. 1 to its position shown in FIG. 2. In the course of this pivoting, the end of the branch 20*a* raises the catch 3 in opposition to the opposing force exerted by its spring 21, the nose portion 3*a* slides along the end of the arm 20*a* and then locks the latter in the closing position (FIG. 2). The latch is then closed and the lever 4 is maintained by the tab 4*b* against the nut 5 which is located at the left end of the screw 6 as viewed in FIG. 2.

In order to open the latch when the control system is in the unlocked position (the latch being connected to an electric locking-unlocking system not shown), one of the electric switches 26 and 27 is actuated. The electric signal is transmitted to the motor through the connector 23 and the tabs 24, 25. The pinion 9*a* drives the shaft 7 in rotation through the gear wheel 7*a*. Consequently, the shaft 7 progressively stresses the spiral spring 8 and drives the screw 6 in rotation through the gear wheel 6*a*. The nut 5, which is prevented from rotating, is therefore shifted toward the opposite end of the screw 6 and exerts a force on the tab 4*b* of the intermediate lever 4. The latter, which is centered by the pin 22 on the upper case (not shown), therefore rotates in the clockwise direction against the opposing force exerted by its return spring 29, and raises by means of its flat surface 4*a* the pin 3*b* rigid with the catch 3.

This movement continues so long as either of the switches 26 and 27 is actuated and until the end of the arm 20*a* is disengaged from the nose portion 3*a*. The latch is then open, the bolt 20 can pivot in the counter-clockwise direction so as to return to its position shown in FIG. 1 when the door 2 is pulled and the keeper 12 is extracted from the latch, the pin 16 returning the bolt 20 to its open position. The assembly continues to operate in this way until the side 5*b* of the nut 5 abuts against a stop 40 rigid with the support plate 10. So long as one of the switches 26 and 27 is actuated, the motor 9 is supplied with current and the whole of the mechanism is retained in the open position, the catch 3 being raised. When the switch 26 or 27 is ceased to be depressed or actuated, the motor 9 ceases to be supplied with current. The torque produced by the spiral return spring 8 stressed to the maximum is greater than the very small torque of the reversibility of the motor 9.

By way of example, the motor 9 is so chosen that, for a supply voltage of 12 Volts, its driving torque is greater than 25 mm/N and its reversibility torque is less than 2 mm/N.

Under these conditions, the spring 8 is released and then drives the shaft 7 in rotation in the opposite direction, which also drives the motor 9 in rotation in the opposite direction through the pinions *7a, 9a* and the screw 6 through the pinion *7b* and the gear wheel *6a*. The nut 5 is consequently returned to its original position to the left (shown in FIG. 2) in abutment against a stop 41 rigid with the plate 10.

The torsion spring 29 at the same time returns the lever 4 in the counter-clockwise direction to a position of abutment against the member 28, and the torsion spring 21 returns the catch 3 downwardly against the lever 4 through the pin *3b*.

If the control system is in the locked position, an action on the buttons of the switches 26 and 27 does not supply current to the motor 9 and the latch remains closed.

In the event of a breakdown in the electric supply system, if the motor 9 is in the stage for raising the catch 3, the spiral spring 8 returns the kinematic device 5, 6, 7 to the closing position, the lever 4 being returned by its spring 29, whatever be the position of this kinematic device at the moment of a breakdown.

If the breakdown in the supply occurs after the disengagement of the bolt 20, the latch is opened normally and is in the position shown in FIG. 1. When the door 2 is closed, the catch 3 normally redescends and the door 2 is latched.

If the breakdown occurs before the disengagement of the bolt 20, the latch remains closed. The spring 8 returns the kinematic device 5, 6, 7 to its position corresponding to the closed door 2, the spring 29 returns the lever 4 in the counter-clockwise direction to a position of abutment against the stop 28 rigid with the case and the catch 3 remains in the position it occupied at the moment of the breakdown. To open the door 2, the safety control 33, 31 must then be used for raising the catch 3 and releasing the bolt 20.

Thus, in the latch according to the invention, in the event of a breakdown in the electric supply system, it is always possible to close and open the door from inside the vehicle. Only the opening from outside the vehicle requires a supply of an emergency electric energy. The inviolability of the vehicle therefore does not depend on the correct operation of the electric supply system.

The kinematic device (gearing, screw pitch) and the torques exerted by the springs 8, 21, 29 are determined in accordance with the driving torque and reversibility torque of the motor 9 in such manner that:

during the raising stage of the catch 3, the driving torque is sufficient for raising this catch, bearing in mind the reactions of the sealing element normally found on a vehicle, and for stressing the spiral spring 8 and for overcoming the resistance of the springs 21 and 29 ;

during the dropping stage of the catch 3, the torque exerted by the return spring 8 is sufficient for returning the kinematic device (gearing, screw and nut) and the motor 9 to the closing position.

By way of a modification, the spiral spring 8 may be replaced by a suitably chosen torsion spring directly mounted on the screw 6 and capable of rotating the latter in the opposite direction and also the gear train 7 and the motor 9, after the opening of the latch and the stopping of the motor.

The latch according to the invention is compact and cheap owing to the simplicity of its structure and of its kinematic arrangement without its overall size exceeding that of conventional mechanical latches.

The electric motor 9 is so chosen as to possess great power for a small overall size and a small reversibility torque, as explained hereinbefore. This permits the use of a suitable resiliently yieldable return element, such as the spiral spring 8, which has a torque which varies but slightly for large travels. This arrangement has the advantage of avoiding the use of:

either means for reversing the voltage supply to the motor 9 which would be necessary in the absence of the return element 8 for returning the nut 5 to the left after opening the latch and for allowing its closure;

or a clutch which, with the latch opened, would isolate the motor 9 from the remainder of the kinematic arrangement, the springs 21 and 29 being then sufficient for returning the latch to the position shown in FIG. 1 and allow the closure.

The retaining elements of this latch, made from steel, are capable of withstanding high stresses, while its control mechanism which is subjected to small stresses, is made with a maximum of elements of plastics material so that the latch is cheaper to manufacture. This latch is disposed in a relatively sealed case which reduces the effect of frost in winter.

What is claimed is:

1. A latch for a motor vehicle door, said latch comprising a keeper, a case, a support plate, a bolt pivotally mounted on the support plate, a cath pivotally mounted on the support plate, a first resiliently yieldable element for returning the catch into cooperative engagement with the bolt, the catch being cooperative with the bolt so as to maintain the bolt in a closing position of the latch under the action of the first resiliently yieldable element, a lever rotatively mounted on the case, an electric control system for controlling the opening of the latch and capable of driving the lever and for pivoting the catch in opposition to the action of the first resiliently yieldable element and releasing the bolt and the keeper inserted in the bolt, the electric control system comprising a motor of sufficient power to overcome the resistance of the first resiliently yieldable element and having a low reversibility torque and a second resiliently yieldable element interposed between the motor and the lever, said second resiliently yieldable element being resiliently stressed by the motor and being resiliently released when the motor no longer carries current so as to return the motor to the initial position of the motor, the lever and the catch being resiliently returned to the initial position thereof after release of the bolt and the pivoting of the bolt to its opening position.

2. The latch of claim 1 wherein the catch and lever are in continuous cooperative engagement with each other at all times regardless of whether the latch is in the open or closed position and regardless of whether the motor carries electric current.

3. A latch according to claim 1, wherein the motor has an output shaft, and a second shaft is drivenly connected to the output shaft, the second resiliently yieldable return element of a kinematic device controlling the opening of the latch being a spiral spring which is mounted coaxially on the second shaft and has one end fixed to said second shaft and an opposite end rigid with the support plate, the latch comprising pivoting means for pivoting the lever and the catch in a direction for releasing the bolt when the motor is operating, and the output shaft of the motor being connected to the lever through said pivoting means and stressing the spiral spring, said pivoting means being automatically actuated in the opposite direction by the release of the spiral spring when the motor no longer carries current and permitting the return of the lever and the catch to the initial positions thereof.

4. A latch according to claim 3, wherein connection means between the output shaft of the motor and the lever comprise a gear train provided with a screw on which is mounted a nut, which nut is prevented from rotating and is movable in translation by rotation of the screw, said nut cooperating with the lever so as to pivot the lever and release the bolt when the motor is operating.

5. The latch of claim 4 wherein the catch and lever are in continuous cooperative engagement with each other at all times regardless of whether the latch is in the open or closed position and regardless of whether the motor carries electric current.

6. The latch of claim 5 wherein the catch and lever are maintained in continuous cooperative engagement by means of a catch pin on the catch and a flat surface on the lever which engages said catch pin.

7. The latch of claim 3 wherein the catch and lever are in continuous cooperative engagement with each other at all times regardless of whether the latch is in the open or closed position and regardless of whether the motor carries electric current.

* * * * *